US009393781B2

(12) United States Patent
Terui et al.

(10) Patent No.: US 9,393,781 B2
(45) Date of Patent: Jul. 19, 2016

(54) LIQUID-DISCHARGING HEAD AND METHOD OF PRODUCING THE SAME

(75) Inventors: Makoto Terui, Yokohama (JP); Yuichiro Kanasugi, Kawasaki (JP); Masaya Uyama, Yokohama (JP); Kouji Harada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1863 days.

(21) Appl. No.: 12/188,020

(22) Filed: Aug. 7, 2008

(65) Prior Publication Data

US 2009/0040266 A1 Feb. 12, 2009

(30) Foreign Application Priority Data

Aug. 8, 2007 (JP) ..... 2007-206520

(51) Int. Cl.
*B41J 2/14* (2006.01)
*B41J 2/16* (2006.01)

(52) U.S. Cl.
CPC ..... *B41J 2/1404* (2013.01); *B41J 2/14137* (2013.01); *B41J 2/14145* (2013.01); *B41J 2/1603* (2013.01); *B41J 2/1628* (2013.01); *B41J 2/1629* (2013.01); *B41J 2/1631* (2013.01); *B41J 2/1632* (2013.01); *B41J 2/1642* (2013.01)

(58) Field of Classification Search
USPC ..... 347/29, 47
See application file for complete search history.

(56) References Cited

U.S. PATENT DOCUMENTS

| | | | | |
|---|---|---|---|---|
| 6,984,024 | B2 | 1/2006 | Shin et al. | |
| 7,559,625 | B2 * | 7/2009 | Furukawa et al. | 347/47 |
| 2003/0197762 | A1 * | 10/2003 | Park et al. | 347/65 |
| 2004/0233254 | A1 | 11/2004 | Kim | |
| 2005/0046677 | A1 | 3/2005 | Park et al. | |

FOREIGN PATENT DOCUMENTS

| | | | |
|---|---|---|---|
| JP | 2002-225277 | A | 8/2002 |
| JP | 2002-316419 | A | 10/2002 |
| JP | 2004-130810 | A | 4/2004 |
| JP | 2006-150744 | A | 6/2006 |
| KR | 10-2003-0082261 | | 10/2003 |
| KR | 10-2005-0021728 | | 3/2005 |
| KR | 10-0484168 | | 4/2005 |

* cited by examiner

*Primary Examiner* — John M Bedtelyon
(74) *Attorney, Agent, or Firm* — Canon USA Inc. IP Division

(57) ABSTRACT

A liquid-discharging head includes a substrate; a flow passage wall-forming layer bonded to the substrate so as to form a flow passage for liquid between the substrate and the flow passage wall-forming layer, the flow passage communicating with a discharge port configured to discharge the liquid; an element configured to generate energy used for discharging the liquid from the discharge port and provided on the flow passage wall-forming layer; a metal layer provided with the discharge port so as to correspond to the element; and a projecting portion made of a metal and extending from the metal layer through the flow passage wall-forming layer and projecting in the direction of the substrate.

11 Claims, 17 Drawing Sheets

LIQUID-DISCHARGING HEAD AND METHOD OF PRODUCING THE SAME

BACKGROUND OF THE INVENTION

1. Field of the Invention

The present invention relates to a liquid-discharging head that discharges a liquid and a method of producing the same. More specifically, the present invention relates to an ink-jet recording head that performs recording by discharging ink onto a recording medium, and a method of producing the same.

2. Description of the Related Art

A liquid-discharging head, such as an ink-jet head, includes discharge ports, liquid passages communicating with the discharge ports, energy-generating units for discharging a liquid, the units being disposed in the liquid passages, a liquid chamber communicating with the liquid passages, and a supply port for supplying ink from an ink tank or the like to the liquid chamber. Ink droplets are discharged from the discharge ports by providing energy generated by the energy-generating units to the ink filling the liquid passages. These discharged ink droplets land on a recording material to form pixels, and thus recording is performed.

Among these liquid-discharging heads, liquid-discharging heads that utilize thermal energy for discharging a liquid can perform recording with a high resolution because a plurality of discharging ports can be arranged in a high density. Furthermore, such liquid-discharging heads are advantageous in that the size of the heads can be easily reduced as a whole.

In general, in such a known liquid-discharging head that utilizes thermal energy, a high-density arrangement is realized by arranging a plurality of exothermic resistive elements in line on a substrate made of, for example, silicon, and a substrate having a heat storage layer and an electrical insulating layer that are used in common for the plurality of exothermic resistive elements is used.

U.S. Pat. No. 6,984,024 discloses a back-shooting-type head, which is an example of an ink-jet head. In a thermally driven ink-jet head, air bubbles are formed in ink by heat generated by an exothermic resistive element (heater) disposed in a liquid passage, and the ink in the liquid passage is discharged from a discharge port by the pressure generated by the growth of the air bubbles. An ink-droplet discharge system in which an ink droplet is discharged in a direction opposite to the direction in which a heater surface on which the air bubbles expand faces is referred to as "back-shooting type".

The back-shooting type head described in U.S. Pat. No. 6,984,024 is produced using a silicon-on-insulator (SOI) wafer. For example, a silicon surface layer and an insulating layer that constitute the SOI wafer have a thickness of 40 μm and 1 μm, respectively. In a production process of the head, first, an ink chamber and a wall of an ink channel are formed. More specifically, a trench is formed, and the trench is then embedded by thermal oxidization. The oxidizing film functions as a stop layer of final isotropic etching using $XeF_2$. After the thermal oxidization, the thermally oxidized film formed on the surface of the substrate is removed by chemical mechanical polishing (CMP).

Subsequently, a heater lower layer, a heater layer and a wiring layer (heater upper layer), and a metal protective film are formed and patterned. Next, a metal seed layer for electroplating is formed, and a positive resist used as a pattern of discharge ports is patterned. A nickel film is formed as a discharge port plate by electroforming so as to have a thickness of 30 μm. Subsequently, a manifold is formed by etching silicon of the lower layer, the insulating layer is then etched. Parylene is then deposited in order to protect exposed silicon portions. Subsequently, a part of the parylene disposed parallel to the substrate surface is etched in order to remove silicon located on positions corresponding to the discharge ports. Finally, the ink chamber and the ink channel communicate with the discharge ports by performing isotropic etching with $XeF_2$.

Nowadays, a large number of recording apparatuses are used, and, for example, high-speed recording, high resolution, high image quality, and low noise have been required for these recording apparatuses. An example of a recording head of a recording apparatus that meets such requirements is an ink-jet head. In an ink-jet head that discharges ink by utilizing thermal energy, stabilization of ink discharge, i.e., stabilization of the amount of ink discharge required for meeting the above needs are significantly affected by the temperature of ink in discharge portions. Specifically, if the temperature of the ink is excessively low, the viscosity of the ink excessively increases. As a result, the ink cannot be discharged by normal thermal energy. On the other hand, if the temperature is excessively high, the amount of discharge increases, and for example, ink may be spilled onto a recording sheet, resulting in a degradation of image quality. Furthermore, in order to realize high-speed recording, a drive frequency (drive frequency for which the time ranging from a discharge of a droplet to the next discharge is defined as one cycle) must be increased by efficiently dissipating heat generated from a heater without storing the heat in a substrate.

On the other hand, in a back-shooting-type ink-jet head, heaters are provided in a discharge port plate having a thickness of about 30 μm. In this structure, the temperature of ink is easily increased because portions having the heaters have a low heat capacity, as compared with a head in which a discharge port plate including liquid passages having heaters therein is stacked on a silicon substrate on which the heaters are formed. Therefore, such a back-shooting-type head is disadvantageous in that the temperature of ink is easily increased, and it is difficult to stabilize the amount of discharge.

SUMMARY OF THE INVENTION

The present invention provides a back-shooting-type liquid-discharging head in which a temperature increase of a recording liquid to be discharged can be suppressed to stabilize the amount of discharge. According to the present invention, even in a back-shooting-type liquid-discharging head, an increase in the temperature of a discharge port plate can be suppressed, and the temperature of ink in a liquid chamber is also not increased easily. As a result, the amount of discharge can be further stabilized.

According to an aspect of the present invention, a liquid-discharging head includes a substrate; a flow passage wall-forming layer bonded to the substrate so as to form a flow passage for liquid between the substrate and the flow passage wall-forming layer, the flow passage communicating with a discharge port configured to discharge the liquid; an element configured to generate energy used for discharging the liquid from the discharge port and provided on the flow passage wall-forming layer; a metal layer provided with the discharge port so as to correspond to the element; and a projecting portion made of a metal and extending from the metal layer through the flow passage wall-forming layer and projecting in the direction of the substrate.

Further features of the present invention will become apparent from the following description of exemplary embodiments with reference to the attached drawings.

DESCRIPTION OF THE EMBODIMENTS

Embodiments of the present invention will now be described with reference to the drawings. Here, descriptions will be made using ink-jet recording heads as examples of liquid-discharging heads of the present invention.

First Embodiment

Figure 1A:
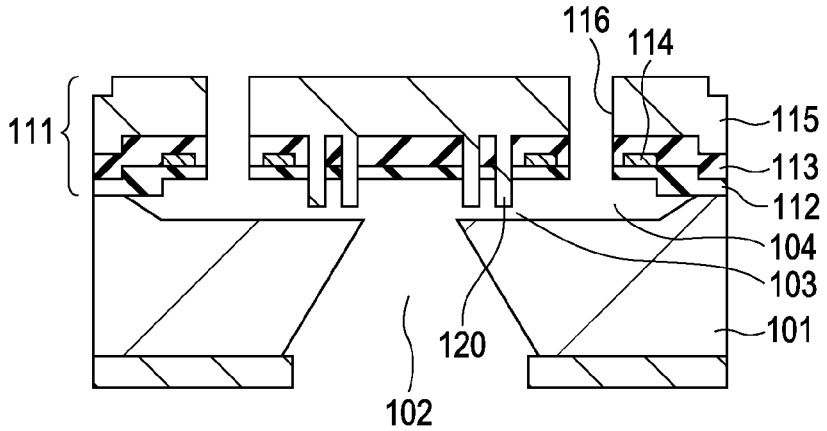
FIG. 1A is a cross-sectional view showing an ink-jet recording head according to a first embodiment of the present invention.
Figure 1B:
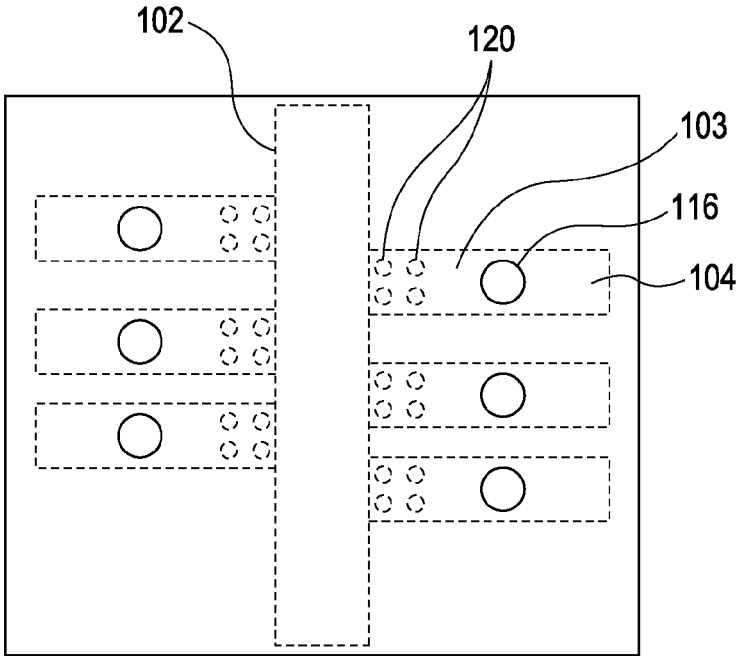
FIG. 1B is a plan view showing the ink-jet recording head according to the first embodiment of the present invention.

FIG. 1A is a cross-sectional view of an ink-jet recording head according to a first embodiment of the present invention, and FIG. 1B is a plan view thereof.

The ink-jet recording head of this embodiment shown in FIGS. 1A and 1B includes a substrate 101 made of silicon and a discharge port plate 111 stacked on the substrate 101. Ink chambers 104 functioning as liquid chambers in which ink to be discharged is filled, and ink channels 103 functioning as channels which supply the ink to the ink chambers 104 are provided on the top surface of the substrate 101. A manifold 102 that supplies the ink to the ink channels 103 is further provided through the substrate 101 so as to penetrate through the top surface and the bottom surface of the substrate 101. The discharge port plate 111 is formed by sequentially stacking a first protective layer 112 and a second protective layer 113 each made of an inorganic substance, and a metal layer 115 on the substrate 101. The protective layers 112 and 113 include heaters 114 serving as exothermic resistive elements and other components therein. The heaters 114 are provided at positions corresponding to the areas of the ink chambers 104. These heaters 114 can be provided at any interlaminar positions between the plurality of inorganic protective layers. Furthermore, a plurality of discharge ports (nozzles) 116 for discharging ink to the discharge port plate 111 are provided so as to communicate with the ink chambers 104. Among the layers included in the discharge port plate 111, the first protective layer 112 also functions as a flow passage wall-forming layer, which forms a part of a wall of a flow passage.

The ink channels 103 are provided on the top surface of the substrate 101 and formed so as to extend from the manifold 102 having a long rectangular opening. The discharge ports 116 communicating with the ink chambers 104 disposed at the most downstream side of each of the ink channels 103 are arranged in one direction.

Furthermore, portions of the metal layer 115 included in the discharge port plate 111 penetrate through the protective layers 112 and 113 and project (stick out) into the ink channels 103, which are areas disposed near the substrate 101 side relative to the protective layer 112. Thus, these portions can be in contact with ink. Hereinafter, these projecting columns are referred to as projecting portions 120.

The projecting portions 120 are formed such that the heat capacity and the surface area thereof can be maximized. In addition, for example, the shape, the dimensions (the width, and the length, and the thickness), and the arrangement are determined so that blocking of inflow of ink from the manifold 102 to the ink channels 103 can be minimized.

Furthermore, the projecting portions 120 also function as a backward flow resistive element that suppresses the propagation of ink flow generated in discharging ink to adjacent ink chambers 104. In addition, the projecting portions 120 also function as a filter that prevents impurities contained in the ink from reaching the ink chambers 104.

Next, an example of a method of producing the above ink-jet recording head will be described with reference to process drawings separately shown in FIG. 2A to FIG. 7C.

In this embodiment, a single-crystal silicon wafer whose surface has a crystal orientation plane of (100) is prepared as a substrate 101.

Figure 2A:
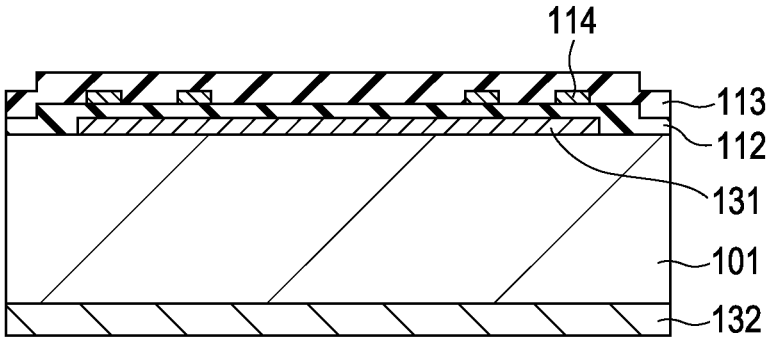
FIGS. 2A to 2C are cross-sectional views illustrating an example of steps of producing the ink-jet recording head of the first embodiment.

Subsequently, a sacrificial layer 131, a first protective layer 112, heaters 114, a conductor (not shown), and a second protective layer 113 are sequentially stacked on the substrate 101 (FIG. 2A).

The first protective layer 112 functions as an insulating layer between the heaters 114 and the substrate 101 and has chemical resistance against a removing agent of the sacrificial layer and the like. The first protective layer 112 is made of, for example, silicon nitride or silicon oxide.

The second protective layer 113 functions as an insulating layer between a metal layer 115 to be formed in a subsequent step and the heaters 114, and protects the heaters 114 and the conductor (not shown) that transmits driving signals to the heaters 114. The second protective layer 113 is made of, for example, silicon nitride or silicon oxide.

The sacrificial layer 131 of this embodiment is etched at a speed sufficiently higher than the speeds at which the substrate 101 and the first protective layer 112 are etched. When silicon nitride is used as the first protective layer 112, silicon oxide can be used as a specific material of the sacrificial layer 131. When hydrogen fluoride gas is used as a removing agent of the sacrificial layer 131, a selection ratio for achieving a sufficiently high etching rate relative to the etching rates of single-crystal silicon constituting the substrate 101 and silicon nitride constituting the first protective layer 112 can be realized.

The heaters 114 and the conductor (not shown) that transmits driving signals to the heaters 114 are formed on the first protective layer 112. Each of the heaters 114 is composed of an exothermic resistive element made of, for example, polysilicon, a tantalum-aluminum alloy, tantalum nitride, titanium nitride, or tungsten silicide doped with an impurity. The conductor that transmits electrical signals to the heaters 114 is made of a metal having good conductivity such as aluminum, an aluminum alloy, gold, or silver.

Also, a reverse surface protective film 132 is formed on the reverse surface of the substrate 101.

Each of the above stacking materials can be deposited by a method such as chemical vapor deposition (CVD) using a plasma. The sacrificial layer 131, the heaters 114, the conductor, and the like are patterned by etching using a photoresist mask.

Figure 2B:
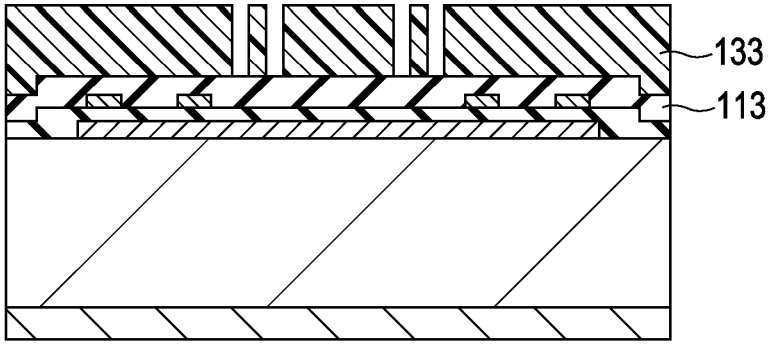

Subsequently, a resist pattern 133 is formed on the second protective layer 113 (FIG. 2B). The resist pattern 133 has openings corresponding to portions which will be formed into projecting portions 120.

Figure 2C:
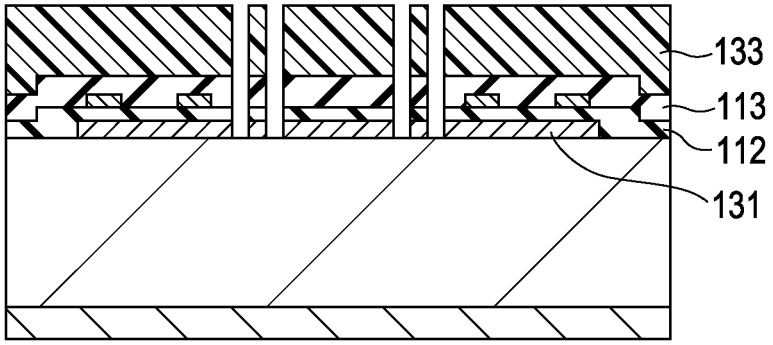

The sacrificial layer 131, the first protective layer 112, and the second protective layer 113 are etched using the resist pattern 133 as a mask (FIG. 2C). In this embodiment, these three layers are etched. Alternatively, in the deposition step shown in FIG. 2A, portions of a metal layer corresponding to the projecting portions 120 may be patterned.

Figure 3A:
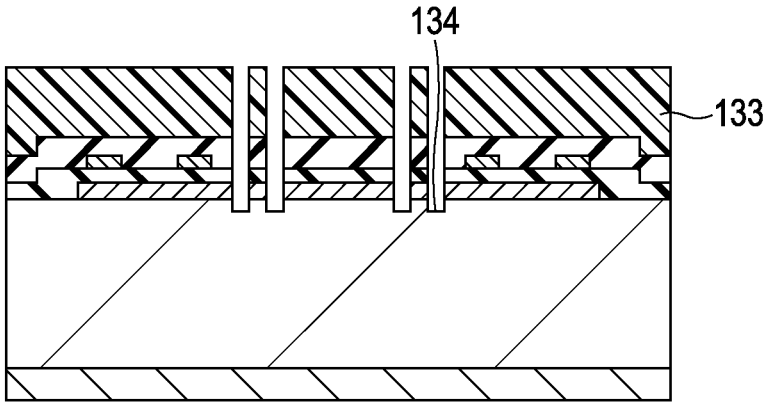
FIGS. 3A to 3D are cross-sectional views illustrating the continuation of the step shown in FIG. 2C.

Furthermore, silicon of the substrate 101 is dry-etched using the resist pattern 133 to form trenches 134 (FIG. 3A). In this step, the trenches 134 are formed so as to reach a depth corresponding to portions to be formed into ink channels 103 in a subsequent step. For example, a mixed gas of sulfur hexafluoride and oxygen is used for the dry etching. For some shapes of the projecting portions 120 to be formed, the etching of silicon may be performed by isotropic wet etching or crystal anisotropic etching.

Figure 3B:
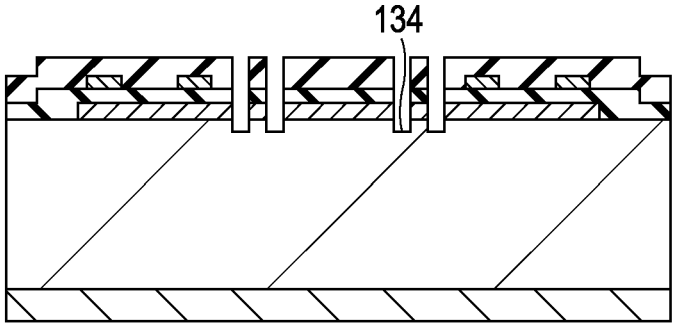

The resist pattern 133 is then removed (FIG. 3B).

Figure 3C:
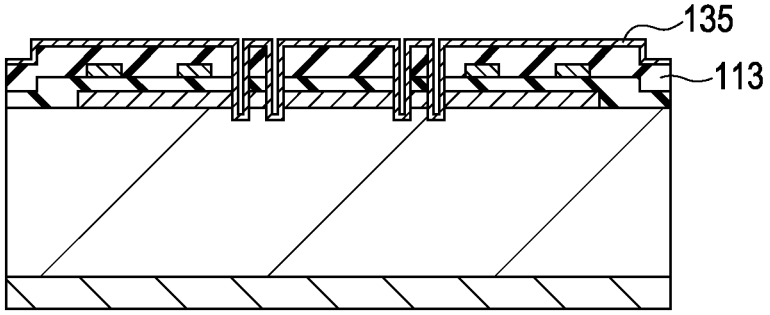

Furthermore, a plating seed layer 135 is deposited on the inner surface of the openings reaching the trenches 134 and the surface of the second protective layer 113 (FIG. 3C). The plating seed layer 135 may be composed of, for example, TiW, Ti/Pd, or Ti/Au. In this embodiment, a description will be made using Ti/Au. The thickness of the Ti layer is 2,000 Å and the thickness of the Au layer is 4,000 Å, but the thicknesses are not limited thereto. For example, vapor deposition can be employed as a method of depositing the plating seed layer 135. When the plating seed layer 135 is formed by vapor deposition, the plating seed layer 135 can be deposited on the bottom and side walls of each of the trenches 134 by disposing the substrate horizontally and at an angle with respect to an evaporation source.

Figure 3D:
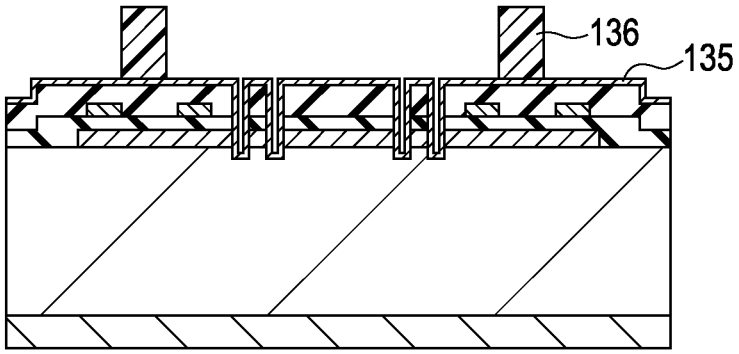

Furthermore, a resist 136 is patterned on the plating seed layer 135 so as to correspond to portions to be formed into discharge ports 116 in a subsequent step (FIG. 3D). A positive resist is used for the resist 136 in this embodiment. Alternatively, a negative resist or a non-photosensitive resist may be used.

Figure 4A:
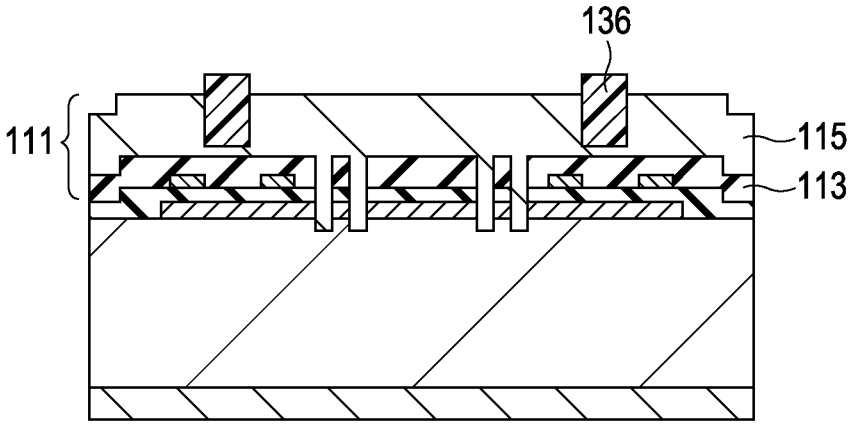
FIGS. 4A to 4D are cross-sectional views illustrating the continuation of the step shown in FIG. 3D.

Next, a metal layer 115 is formed on the second protective layer 113 so that a metal material sufficiently fills inside the trenches 134 (FIG. 4A). The metal layer 115 can be formed by, for example, electroplating. The thickness of the plating layer is in the range of about 40 to 70 μm. For example, gold (Au) or nickel (Ni) is used as the material of the metal layer 115 formed by plating. The total thickness of the stacked metal layer 115 and the protective layers 112 and 113 substantially corresponds to the length of a discharge port (i.e., the thickness of a discharge port plate 111). Therefore, the thicknesses of the layers are determined in consideration of a desired length of the discharge port. In this embodiment, a description will be made using a discharge port plate 111 composed of a gold (Au) layer having a thickness of 30 μm.

The formed metal layer 115 is affected by the presence of the openings in the second protective layer 113 and has irregularities on the surface thereof. Accordingly, in order to remove the irregularities, the surface of the metal layer 115 may be planarized by surface polishing.

Figure 4B:
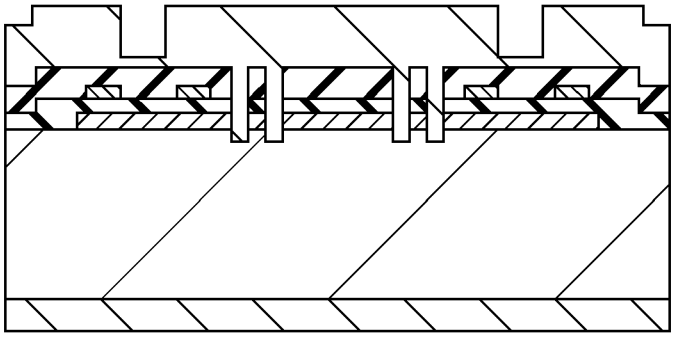

The resist 136 is then removed (FIG. 4B).

Figure 4C:
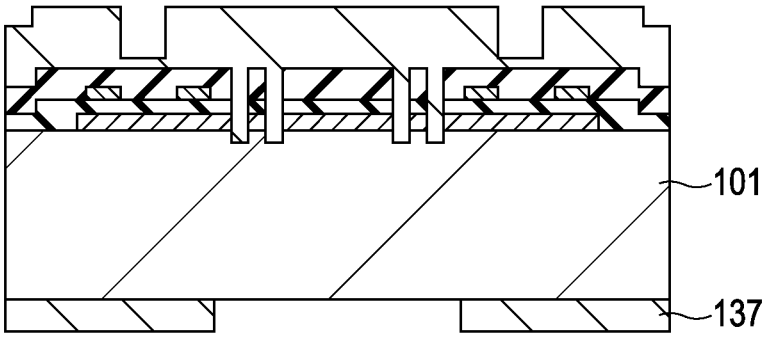

Next, a reverse-face protective film pattern 137 is formed on the reverse face of the substrate 101 (FIG. 4C). An opening of the reverse-face protective film pattern 137 is formed so as to correspond to a portion to be formed into a manifold 102 in a subsequent step.

Figure 4D:
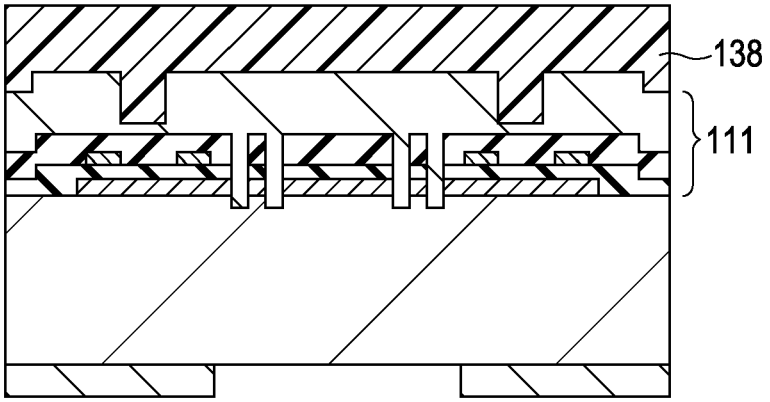

A surface protective resist 138 for protecting the discharge port plate 111 during crystal anisotropic etching in a subsequent step is applied on the top surface of the substrate 101 (FIG. 4D).

Figure 5A:
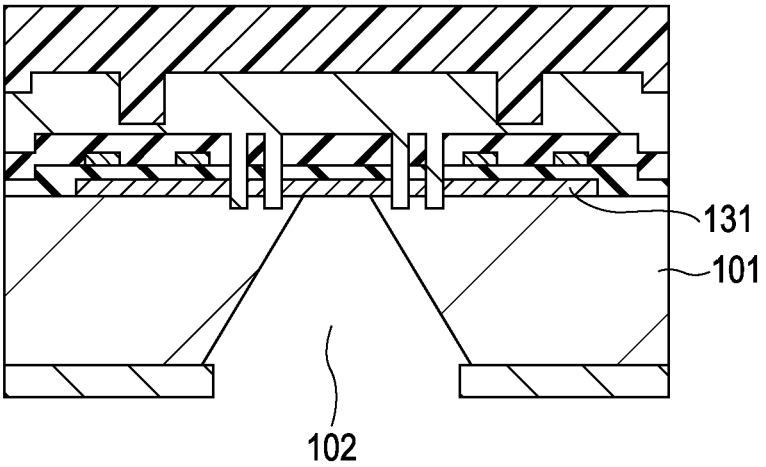
FIGS. 5A to 5C are cross-sectional views illustrating the continuation of the step shown in FIG. 4D.

Next, the manifold 102 is formed in the substrate 101 by crystal anisotropic etching (FIG. 5A). Tetramethylammonium hydroxide (TMAH) is used as this etchant. Alternatively, for example, potassium hydroxide (KOH) may also be used. The manifold 102 is formed so as to extend from the reverse face of the substrate 101 to the sacrificial layer 131 disposed on the top face of the substrate 101. That is, the sacrificial layer 131 functions as an etching stop layer of this etching.

Figure 5B:
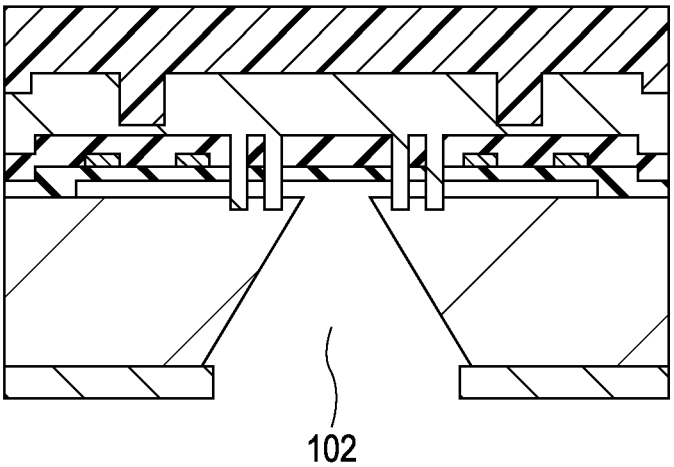

Next, the sacrificial layer 131 is removed through the opening of the manifold 102 (FIG. 5B). In this embodiment, since silicon oxide is used as the sacrificial layer 131, the sacrificial layer 131 is etched using anhydrous hydrofluoric acid (AHF). When the sacrificial layer 131 is made of polysilicon, aluminum, or the like, the sacrificial layer 131 can be removed by wet etching using an alkaline solution.

Figure 5C:
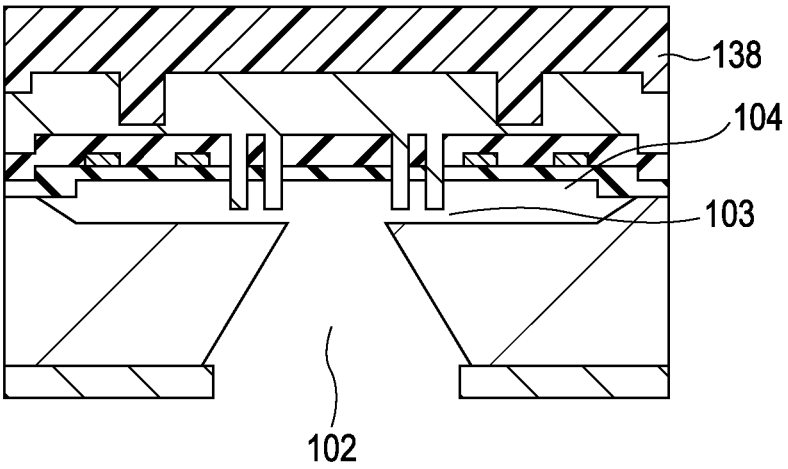

Furthermore, an etchant is introduced into the space formed by removing the sacrificial layer 131 through the manifold 102 to etch the single-crystal silicon substrate 101 from the space. Accordingly, flow passages corresponding to ink chambers 104 and ink channels 103 are formed (FIG. 5C). TMAH or KOH can be used as this etchant as in the above-described etching step.

Figure 6A:
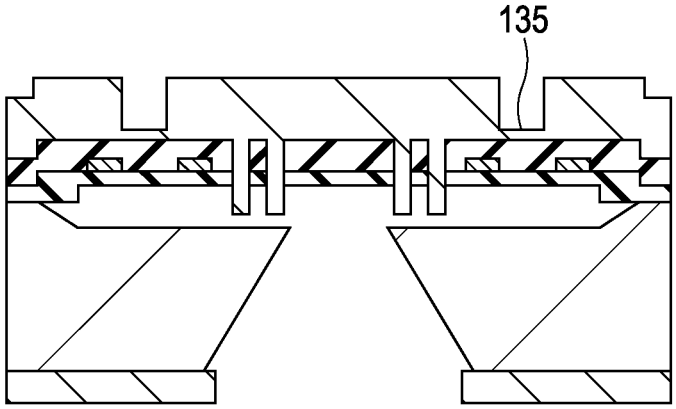
FIGS. 6A and 6B are cross-sectional views illustrating the continuation of the step shown in FIG. 5C.
Figure 6B:
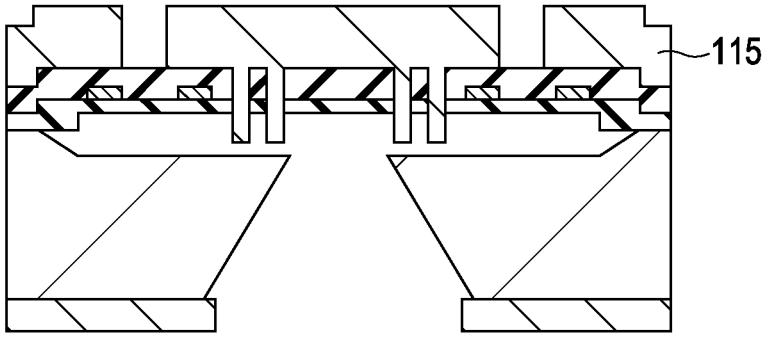

Subsequently, the surface protective resist 138 is removed (FIG. 6A). The plating seed layer 135 remaining under the resist 136 used during the formation of the metal layer 115 is then removed using an etchant (FIG. 6B). In this embodiment, the discharge port plate 111 has a thickness of 30 μm. The thickness of the Ti layer and the thickness of the Au layer, the layers constituting the plating seed layer 135, are 2,000 Å and 4,000 Å, respectively. Thus, the thickness of the plating seed layer 135 is sufficiently smaller than the thickness of the discharge port plate 111. Therefore, even when the plating seed layer 135 is wet-etched as described above, the effect on the dimensions of the projecting portions 120 and the discharge port plate 111 is very small. A mixed solution of HF, $HNO_3$, and $H_2O$ may be used for etching Ti, and aqua regia may be used for etching Au.

Figure 7A:
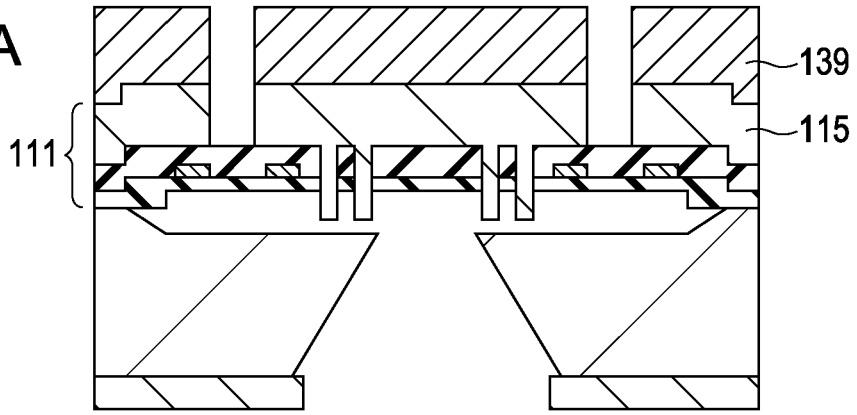
FIGS. 7A to 7C are cross-sectional views illustrating the continuation of the step shown in FIG. 6B.

Next, prior to dry etching performed for communicating the discharge ports 116 with portions to be formed into the ink chambers 104, a dry film 139 is patterned as a mask for protecting the discharge port plate 111 (FIG. 7A). Alternatively, a liquid resist may also be used as the mask. However, a dry film is used in this embodiment in consideration of the yield because trenches to be formed into the discharge ports 116 have been formed in the discharge port plate 111.

Figure 7B:
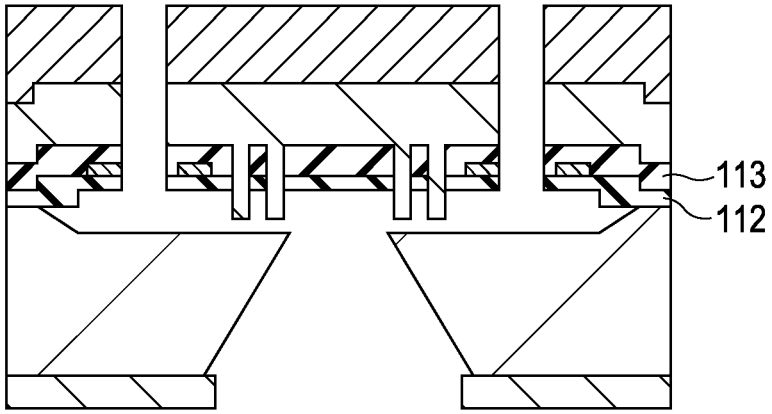

Subsequently, the first protective layer 112 and the second protective layer 113 are etched by dry etching (FIG. 7B). The second protective layer 113 may be made of SiO and may be etched by reactive ion etching (RIE) using a mixed gas of $CF_4$, $CHF_3$, and Ar as an etching gas. The first protective layer 112 may be made of SiN and may be etched by RIE using a mixed gas of $CF_4$, $CHF_3$, Ar, and $O_2$ as an etching gas.

Figure 7C:
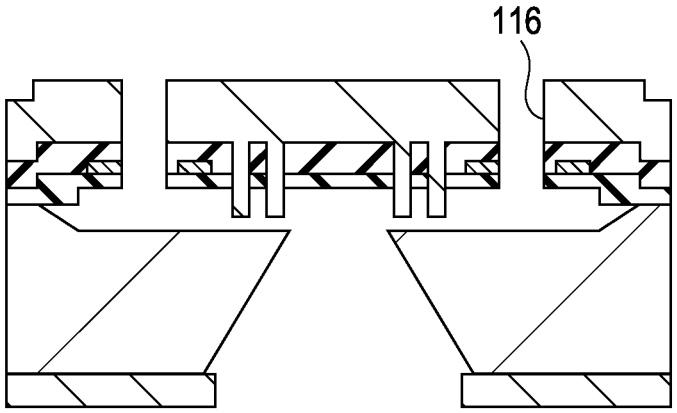

Subsequently, the dry film 139 used for protecting the discharge port plate 111 is removed (FIG. 7C).

Finally, the resulting silicon wafer is separated into desired chip units using a dicer, as needed. Thus, the ink-jet recording head can be produced.

By providing the projecting portions 120 that contact ink in the flow passages on the discharge port plate 111 including the heaters 114, heat storage in bubble-generating portions can be suppressed even in a successive printing. Consequently, an effect of stabilizing the amount of discharge can be achieved.

Second Embodiment

Figure 8A:
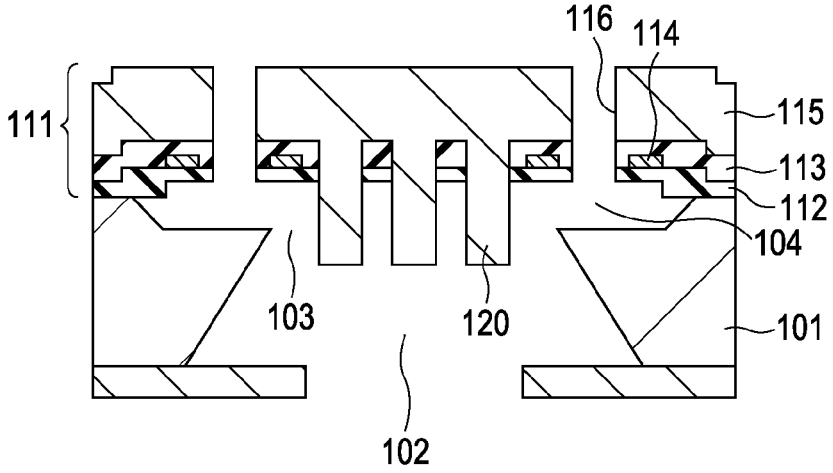
FIG. 8A is a cross-sectional view showing an ink-jet recording head according to a second embodiment of the present invention.
Figure 8B:
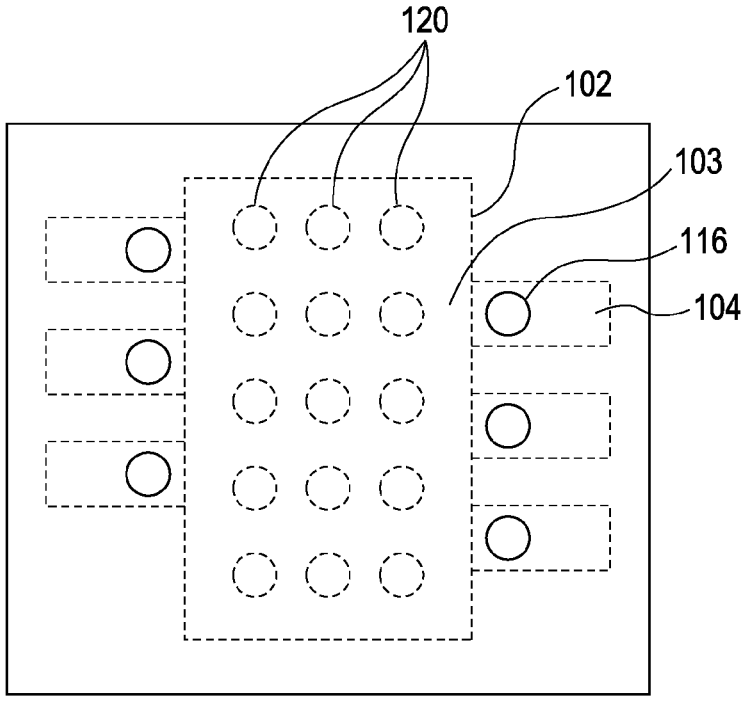
FIG. 8B is a plan view showing the ink-jet recording head according to the second embodiment of the present invention.
Figure 9A:
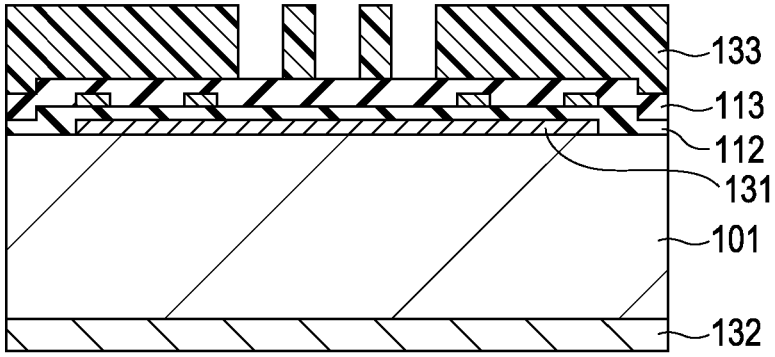
FIGS. 9A to 9C are cross-sectional views illustrating an example of steps of producing the ink-jet recording head of the second embodiment.
Figure 9B:
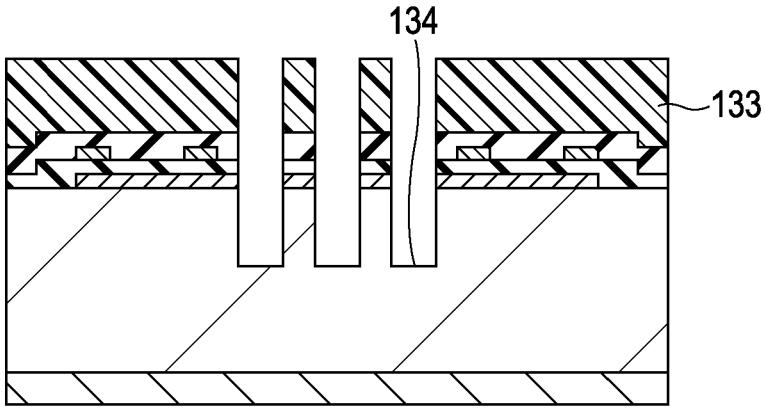
Figure 9C:
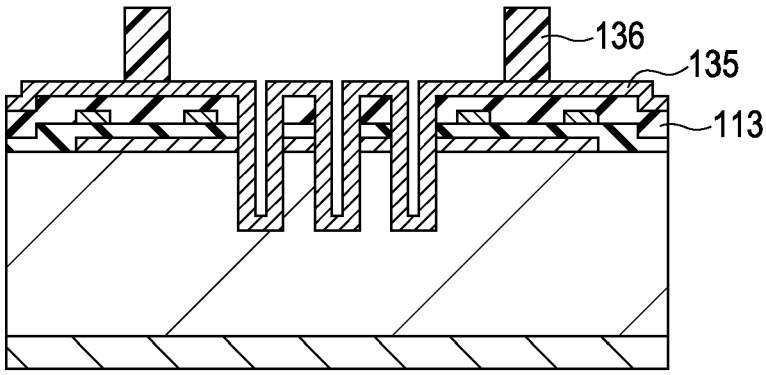
Figure 10A:
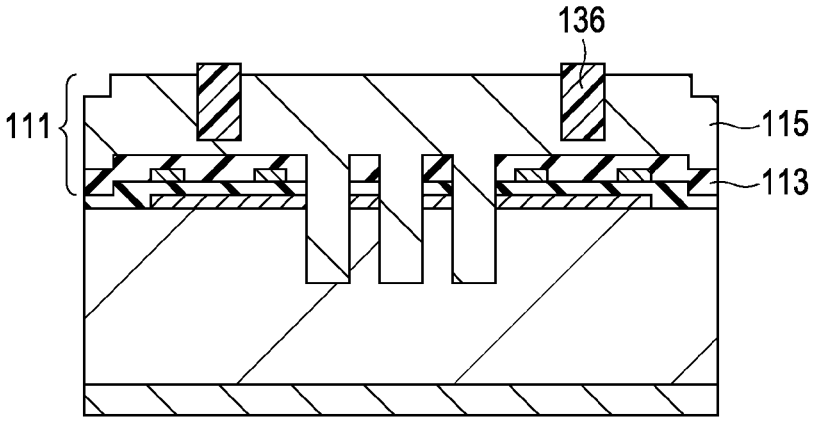
FIGS. 10A to 10C are cross-sectional views illustrating the continuation of the step shown in FIG. 9C.
Figure 10B:
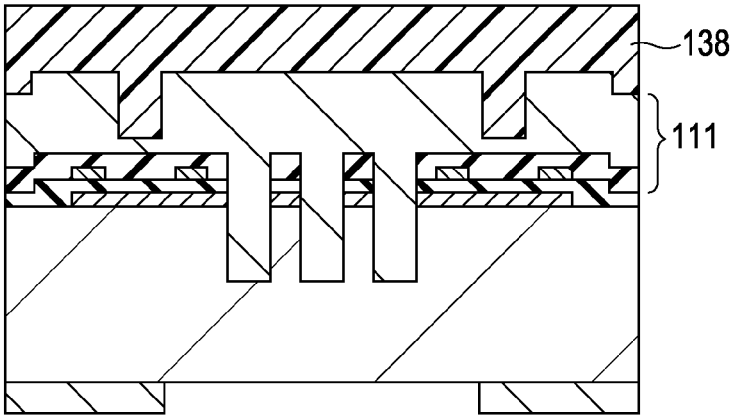
Figure 10C:
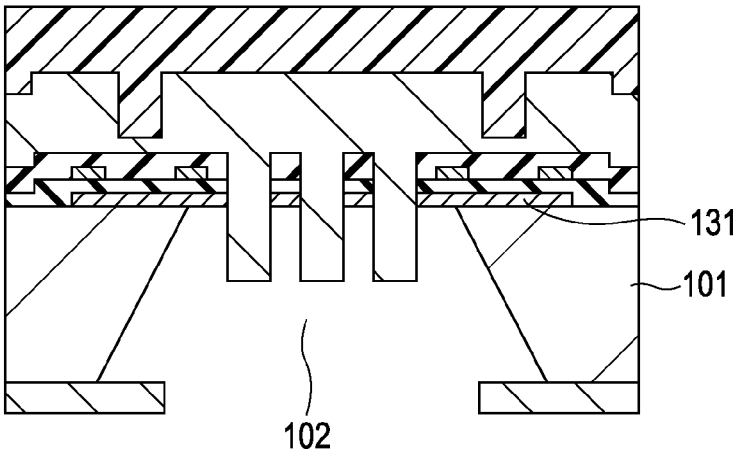
Figure 11A:
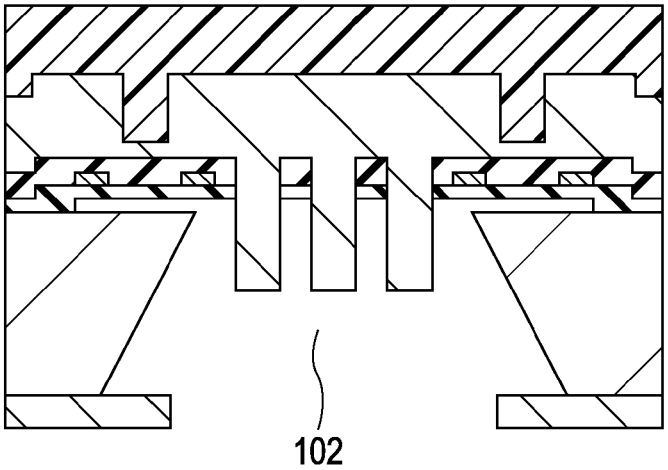
FIGS. 11A to 11C are cross-sectional views illustrating the continuation of the step shown in FIG. 10C.
Figure 11B:
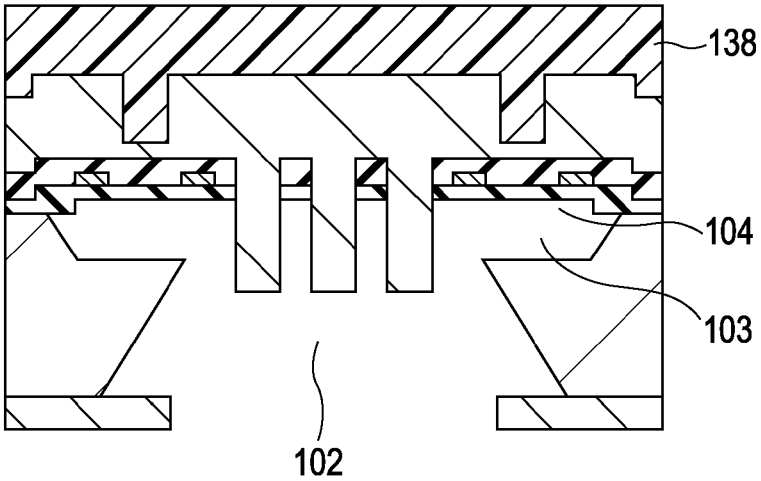
Figure 11C:
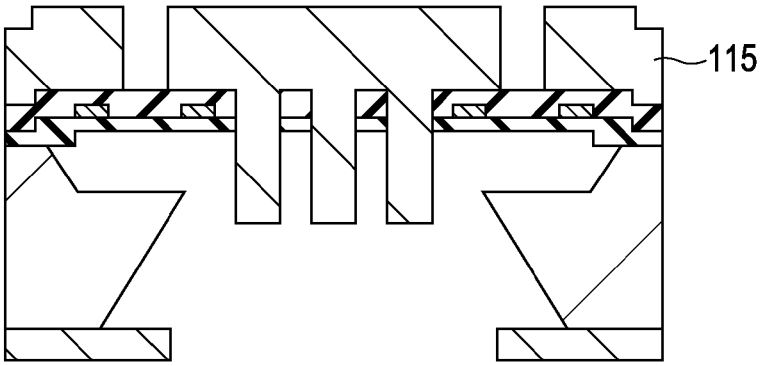
Figure 12A:
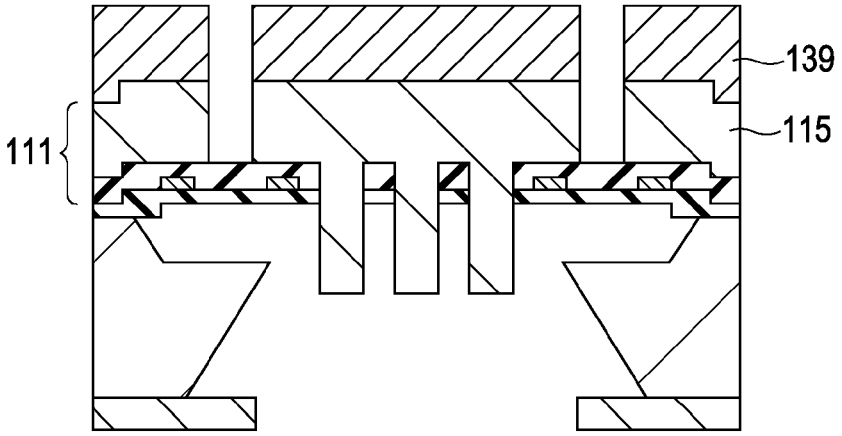
FIGS. 12A and 12B are cross-sectional views illustrating the continuation of the step shown in FIG. 11C.
Figure 12B:
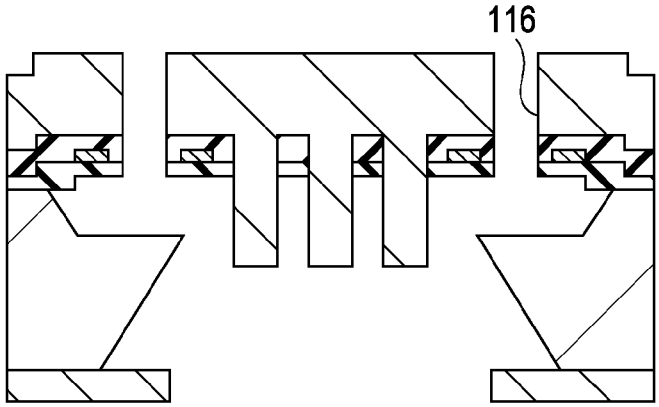

FIG. 8A is a cross-sectional view of an ink-jet recording head according to a second embodiment of the present invention, and FIG. 8B is a plan view thereof. The same components as those in the first embodiment are assigned the same reference numerals, and the description of these components is omitted here. Components that are different from those in the first embodiment will now be described.

In this embodiment, as shown in FIG. 8A, projecting portions 120, which are portions of a metal layer 115 included in a discharge port plate 111, penetrate through protective layers 112 and 113 and project (stick out) into a manifold 102. Thus, the projecting portions can contact ink. In the first embodiment, one or more projecting portions 120 are provided in each flow passage connected to each ink chamber 104. In contrast, in this embodiment, one or more projecting portions 120 are provided in an opening of the manifold 102 at the top surface side of the substrate 101. The ink-jet recording head of this embodiment differs from the ink-jet recording head of the first embodiment in this point.

FIGS. 9A to 12B show an example of a method of producing the above ink-jet recording head. In the method of this embodiment, the positions and the depth of trenches 134 formed by dry-etching silicon of the substrate 101 are different from those in the first embodiment. Specifically, unlike the steps shown in FIGS. 2A to 3A of the first embodiment, in this embodiment, the trenches 134 to be formed by dry-etching the silicon substrate 101 are formed so as to extend to the depth corresponding to the inside of a portion to be formed into the manifold 102 (see FIGS. 9B and 11A). The method of producing the ink-jet recording head of this embodiment is the same as the method described in the first embodiment except for this point. In this embodiment, since heat storage in the discharge port plate 111 including heaters 114 can be suppressed, the effect of stabilizing the amount of discharge can be obtained as in the first embodiment.

Third Embodiment

Figure 13A:
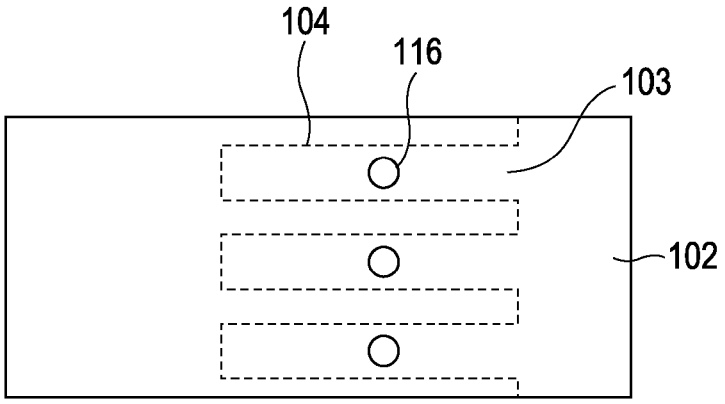
FIG. 13A is a cross-sectional view showing an ink-jet recording head according to a third embodiment of the present invention.
Figure 13B:
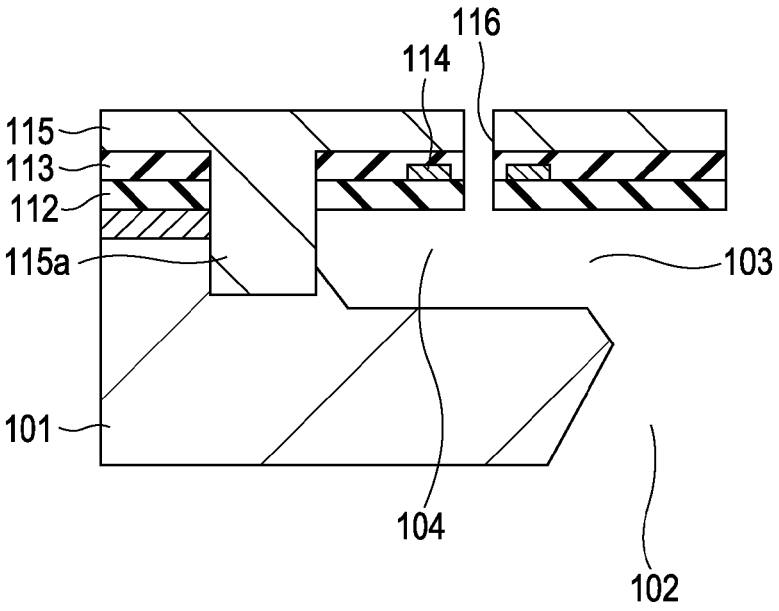
FIG. 13B is a plan view showing the ink-jet recording head according to the third embodiment of the present invention.

FIG. 13A is a cross-sectional view of an ink-jet recording head according to a third embodiment of the present invention, and FIG. 13B is a plan view thereof. The same components as those in the first embodiment are assigned the same reference numerals, and the description of these components is omitted here. Components that are different from those in the first embodiment will now be described.

In this embodiment, as shown in FIGS. 13A and 13B, a portion 115*a* of a metal layer 115 included in a discharge port plate 111 penetrates through protective layers 112 and 113 and projects, and is embedded in a substrate 101. In addition, this projecting portion 115*a* also functions as a part of a wall surface of ink channels 103 and ink chambers 104.

It is believed that, by bringing a portion of the metal layer 115 into directly contact with the substrate 101, heat generated from heaters 114 can be more effectively dissipated, and thus, the drive frequency can be improved, as compared with the first and second embodiments.

FIG. 14A to FIG. 14H show an example of a method of producing the above ink-jet recording head. The method of this example includes the same step as that shown in FIG. 2A (the step of depositing the sacrificial layer 131 and the protective layers 112 and 113) and the same steps as those shown in FIGS. 5A to 7C (the steps of forming the manifold 102, the ink channels 103, the ink chambers 104, and the discharge ports 116) described in the first embodiment. Therefore, steps of forming other portions will be mainly described. Note that the same materials as those used in the first embodiment can be used for forming the ink-jet recording head of this embodiment unless otherwise stated.

Figure 14A:
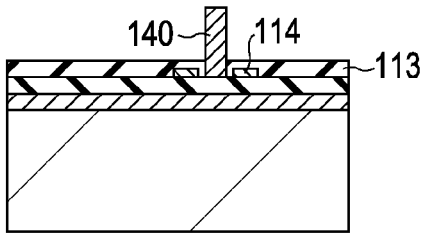
FIGS. 14A to 14H are cross-sectional views illustrating an example of steps of producing the ink-jet recording head of the third embodiment.

First, prior to the deposition of the second protective layer 113, which is shown in FIG. 2A, a discharge port pattern 140 is formed at a predetermined portion to be formed into a discharge port 116 using a positive resist, a photosensitive polymer, or the like (FIG. 14A). The height of the discharge port pattern 140 can be in the range of about 50 to 100 μm.

Next, a second protective layer 113 is formed on a first protective layer 112, heaters 114, and a conductor (not shown) that transmits electrical signals to the heaters 114.

A part of the sacrificial layer 131 and the protective layers 112 and 113, the part capable of being formed into a part of the wall surface of an ink chamber 104 and an ink channel 103, is removed. In this step, the positive resist or the like was patterned by a lithography process, and the part was removed by reactive ion etching.

Figure 14B:
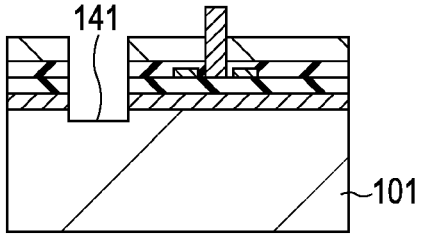

Subsequently, a trench 141 is formed on single-crystal silicon constituting the substrate 101 by etching to a depth substantially the same height of the wall surface of the ink chamber and the ink channel to be formed (FIG. 14B). A dry etching method can be employed as a method of etching silicon. In this step, a photoresist may be patterned and used as a mask. Alternatively, the etching may be performed using the above-mentioned mask used for etching the protective layers and the like. The depth of the etching is in the range of about 10 to 30 μm, but the etching depth can be determined in consideration of the depth corresponding to the part to be formed in to the ink chamber 104 and the ink channel 103.

Next, the metal layer 115 is formed so as to sufficiently fill the trench 141 formed on the second protective layer 113 and the single-crystal silicon.

The formed metal layer 115 is affected by the presence of the trench 141 and has irregularities on the surface thereof.

Figure 14C:
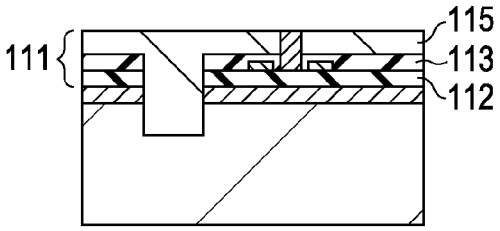

Accordingly, in order to remove the irregularities, the surface of the metal layer 115 may be planarized by surface polishing (FIG. 14C). In this case, the total thickness of the stacked metal layer 115 and the protective layers 112 and 113 substantially corresponds to the length of a discharge port (i.e., the thickness of the discharge port plate 111).

Next, in order to protect portions to be formed into the discharge ports 116, a protective material such as a cyclized rubber 142 is applied on the top surface side of the substrate (on the discharge port plate 111).

Figure 14D:
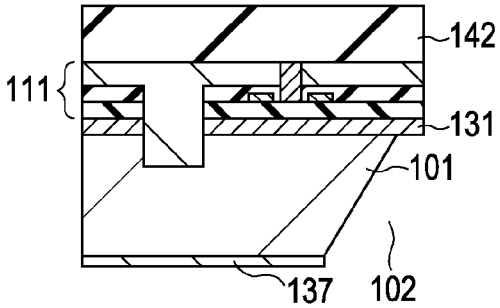

Furthermore, a resist is formed on the reverse face of the substrate 101 and patterned so as to have an opening at a predetermined position at which a manifold 102 is to be formed. The manifold 102 is formed using this resist as a mask (reverse-face protective film pattern 137) (FIG. 14D).

In forming the manifold 102, the substrate 101 is immersed in an alkaline aqueous solution such as an aqueous solution of potassium hydroxide (KOH) or tetramethylammonium hydroxide (TMAH) to perform crystal anisotropic etching from the opening of the reverse-face protective film pattern 137. The etching is finished when the single-crystal silicon substrate 101 is penetrated to communicate with the sacrificial layer 131. Thus, the manifold 102 is formed.

Figure 14E:
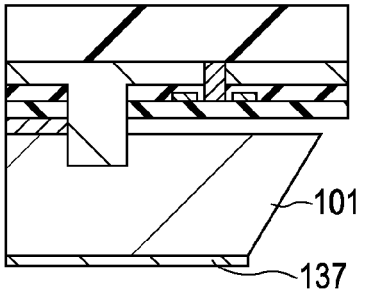

Next, the sacrificial layer 131 is removed through the manifold 102 (FIG. 14E). When the sacrificial layer 131 is made of silicon oxide, etching is performed using a hydrofluoric acid gas. When the sacrificial layer 131 is made of, for example, polysilicon or aluminum, the sacrificial layer 131 can be removed by wet etching using an alkaline solution.

Figure 14F:
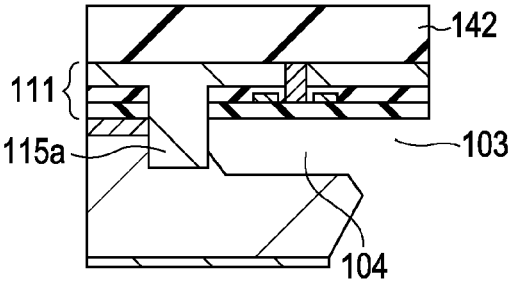

Furthermore, an etchant is introduced into the space formed by removing the sacrificial layer 131 through the manifold 102 to etch the single-crystal silicon substrate 101 from the space. Accordingly, a flow passage corresponding to the ink chamber 104 and the ink channel 103 is formed (FIG. 14F). In this case, in an area where a wall surface of the ink chamber 104 and the ink channel 103 is formed by a portion 115*a* of the metal layer 115 in the discharge port plate 111, the portion 115*a* functions as an etching stop layer. Accordingly, in the area where the metal layer 115 functions as the wall surface of the ink chamber 104 and the ink channel 103, the dimensional accuracy can be improved in forming the ink chamber 104 and the ink channel 103.

Figure 14G:
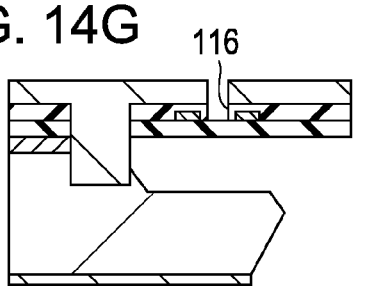

After the formation of the manifold 102, the ink channel 103, and the ink chamber 104, the cyclized rubber 142, which is a protective material formed on the discharge port plate 111, is removed using, for example, xylene (FIG. 14G).

The positive resist or the photosensitive polymer used as the discharge port pattern 140 is then removed to form the upper part of the discharge port 116. Thus, the outside and the first protective layer 112 communicate with each other through the upper part of the discharge port 116 (FIG. 14G).

Figure 14H:
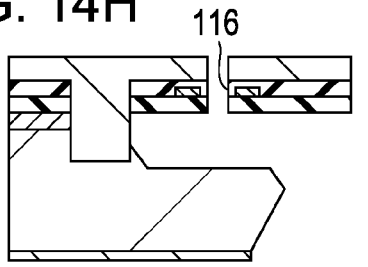

Next, the first protective layer 112 communicating with the outside is removed from the discharge port plate 111 side by, for example, reactive ion etching, chemical dry etching, or sand blasting via an appropriate mask so as to form the lower part of the discharge port 116 (FIG. 14H).

Finally, the resulting silicon wafer is separated into desired chip units using a dicer, as needed. Thus, the ink-jet recording head can be produced.

The ink-jet recording head and the method of producing the head described above have the following advantages.

Since the portion 115*a* of the metal layer 115 having good thermal conductivity included in the discharge port plate 111 is directly in contact with the substrate 101, heat remaining in the heaters 114 and the periphery thereof can be effectively dissipated to the substrate 101. Accordingly, this structure can suppress an increase in the temperature at the discharge ports. As a result, the drive frequency can be improved.

Furthermore, since the portion 115*a* of the metal layer 115 functions as a part of a wall surface of the ink channel 103 and the ink chamber 104, the portion 115*a* of the metal layer 115 effectively functions as an etching stop layer during the formation of the ink channel 103 and the ink chamber 104. Accordingly, the dimensional accuracy during processing of the ink channel 103 and the ink chamber 104 can be improved. As a result, the discharge ports 116 can be arranged at a high density.

Fourth Embodiment

Figure 15:
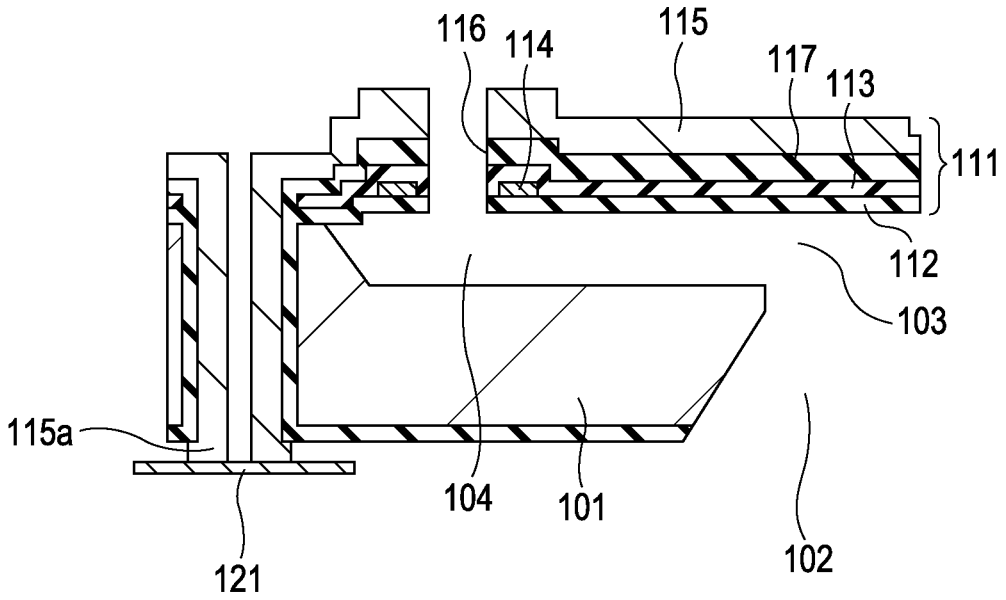
FIG. 15 is a cross-sectional view showing an ink-jet recording head according to a fourth embodiment of the present invention.

FIG. 15 is a cross-sectional view showing an ink-jet recording head according to a fourth embodiment of the present invention. The same components as those in the first embodiment are assigned the same reference numerals, and the description of these components is omitted here. Components that are different from those in the first embodiment will now be described.

In this embodiment, as shown in FIG. 15, a portion 115*a* of a metal layer 115 included in a discharge port plate 111 penetrates through the reverse face of a substrate 101 and is joined to a heat-dissipating member 121.

In addition, the metal layer 115 dissipates heat generated in heaters 114 and the periphery thereof to the outside (heat-dissipating member 121). Examples of the material of the metal layer 115 include metals having good thermal conductivity, such as nickel (Ni), copper (Cu), aluminum (Al), and gold (Au). However, gold (Au) can be used as the metal layer 115 because not only thermal conductivity but also ink resistance (corrosion resistance) is required for the metal layer 115 functioning as a top surface layer of the discharge port plate 111.

More specifically, a barrier layer made of, for example, titanium tungsten (TiW), and a seed layer made of, for example, copper (Cu), chromium (Cr), titanium (Ti), gold (Au), or nickel (Ni) may be provided under the metal layer 115.

The heat-dissipating member 121 has a low thermal resistance and a large heat capacity in order to diffuse heat transmitted from the metal layer 115. In order to reduce the thermal resistance with the metal layer 115, a metal layer having an area larger than the area of an end of the metal layer 115 may be formed on the heat-dissipating member 121 by, for example, gold plating. In such a case, by increasing the contact area or increasing the volume in order to increase the heat capacity, a higher heat dissipation efficiency can be achieved.

FIGS. 16A to 16F show an example of a method of producing the above ink-jet recording head. The method of this example includes the same step as that shown in FIG. 2A (the step of depositing the sacrificial layer 131 and the protective layers 112 and 113) and the same steps as those shown in FIGS. 5A to 7C (the steps of forming the manifold 102, the ink channels 103, the ink chambers 104, and the discharge ports 116) described in the first embodiment. Therefore, steps of forming other portions will be mainly described. Note that the same materials as those used in the first embodiment can be used for forming the ink-jet recording head of this embodiment unless otherwise stated.

Figure 16A:
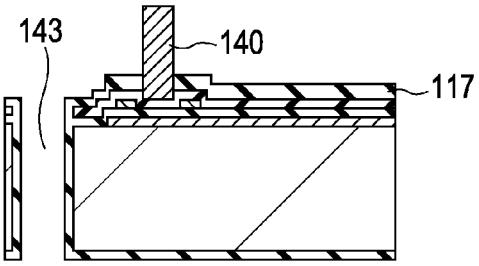
FIGS. 16A to 16F are cross-sectional views illustrating an example of steps of producing the ink-jet recording head of the fourth embodiment.

First, prior to the deposition of a third protective layer 117, which corresponds to the second protective layer 113 shown in FIG. 2A, a discharge port pattern 140 is patterned at a predetermined position to be formed into a discharge port 116 using a positive resist, a photosensitive polymer, or the like (FIG. 16A).

Next, the third protective layer 117 is formed on a second protective layer 113 and a conductor (not shown) that transmits electrical signals to heaters 114. A through-hole 143 penetrating through the protective layers 112, 113, and 117 and the substrate 101 is then formed (FIG. 16A).

The through-hole 143 is formed by sequentially etching the protective layers 112, 113, and 117 and the substrate 101 by reactive ion etching (RIE), which is a dry process. Alternatively, for example, an excimer laser process or sand blasting may also be used.

Figure 16D:
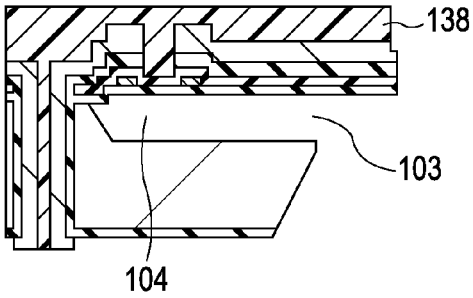
Figure 16B:
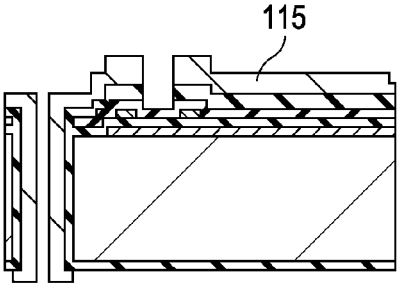

Next, a metal layer 115 is formed on the third protective layer 117 and inside the through-hole 143 (FIG. 16B). In this step, in order to form the metal layer 115 by plating, a plating barrier layer made of titanium tungsten (TiW) and a plating seed layer made of gold (Au) are deposited by sputtering in advance. Subsequently, a gold (Au) plating layer is formed as the metal layer 115 by electroplating or electroless plating. Since the metal layer 115 located on a heat-dissipating member 121 is used for the purpose of heat dissipation, electroplating can be used in order to form the metal layer 115 having a large thickness.

Furthermore, the metal layer 115 must be formed so as to have a projecting shape projecting from the reverse face of the substrate 101 (i.e., the face opposite a discharge port plate 111). In this case, the metal layer 115 in the through-hole 143 may be formed so as to have a cylindrical shape or a bar shape. The metal layer 115 in the through-hole 143 may be formed so as to have a bar shape in order to increase the heat capacity.

Figure 16E:
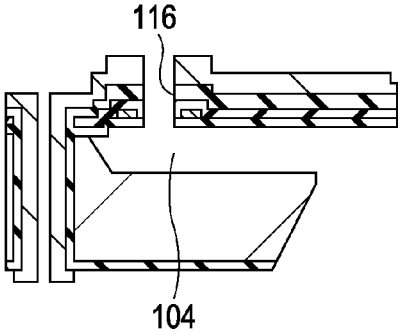
Figure 16C:
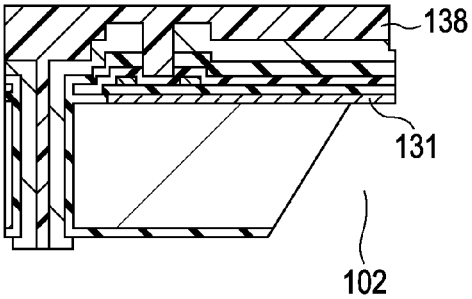
Figure 16F:
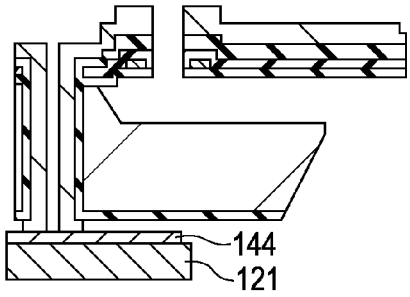

Next, a manifold 102 is formed by performing a first isotropic etching (AE) process, which is a wet process, from the reverse face side of the substrate 101 (FIG. 16C). In this step, a sacrificial layer 131 functions as an etching stop layer.

Furthermore, the sacrificial layer 131 is removed through the manifold 102 by etching using anhydrous hydrofluoric acid. Subsequently, the substrate 101 is etched along the (111) plane of silicon by performing a second isotropic etching (AE) process to form an ink channel 103 and an ink chamber 104 (FIG. 16D).

Furthermore, a surface protective resist 138 is removed, and a pattern mask is then formed using a dry film. The protective layers 112 and 113 are removed by a dry etching process, thus allowing the discharge port 116 to communicate with the ink chamber 104 (FIG. 16E).

Subsequently, an end of the metal layer 115 is joined to a metal layer 144 that is formed on an alumina ($Al_2O_3$) heat-dissipating member 121 by plating (FIG. 16F) In this step, the projecting portion of the metal layer 115 and the metal layer 144 are aligned so as to face each other, and then bonded under pressure. An ultrasonic treatment is performed in this state, thus bonding the metal layers by the metallic bond between gold and gold. The alumina constituting the heat-dissipating member 121 has a volume larger than the volume of the discharge port plate 111, and thus has a large heat capacity. Consequently, heat near the heaters 114 can be effectively dissipated through the metal layer 115 to the heat-dissipating member 121. In this embodiment, alumina is used as the heat-dissipating member 121. However, in the present invention, the material of the heat-dissipating member 121 is not limited thereto.

Figure 17:
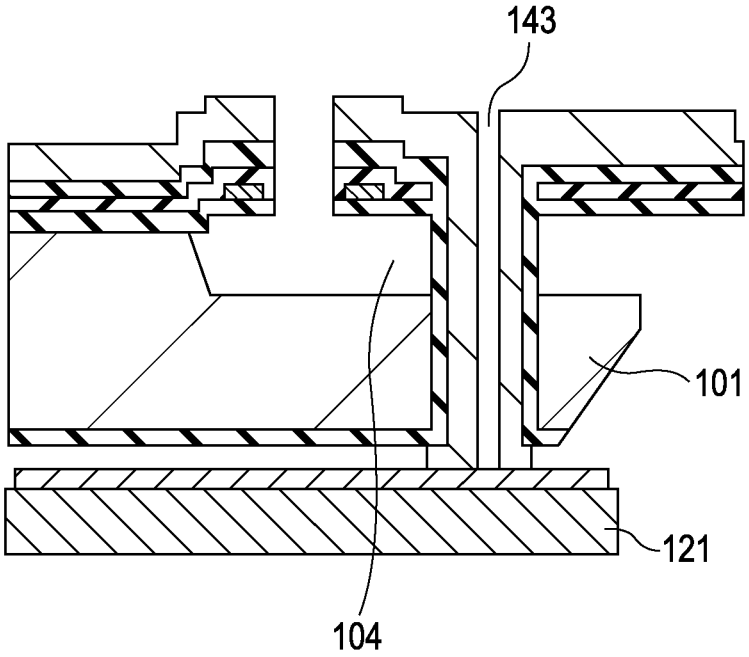
FIG. 17 is a cross-sectional view showing another ink-jet recording head according to the fourth embodiment of the present invention.

Alternatively, as shown in FIG. 17, the through-hole 143 may be formed so as to penetrate through the ink channel 103 and the substrate 101. In this case, the projecting portion of the discharge port plate 111 is formed so as to penetrate through the ink channel 103 and contacts ink. Therefore, heat can be dissipated not only to the heat-dissipating member 121 but also to the ink. Consequently, the heat dissipation efficiency can be improved.

By providing the heat dissipation path penetrating through the substrate 101 on the discharge port plate 111 including the heaters 114, heat storage in bubble-generating portions can be suppressed even in a successive printing. Consequently, an effect of stabilizing the amount of discharge can be achieved.

More specifically, according to this embodiment, in a back-shooting-type ink-jet head, a portion of the metal layer 115 included in the discharge port plate 111 penetrates through the substrate 101 and is joined to the heat-dissipating member 121. Accordingly, heat generated from the heaters 114 can be dissipated to the heat-dissipating member 121 through the metal layer 115 to suppress an increase in the temperature of the discharge port plate 111. As a result, an increase in the temperature of ink can also be suppressed, and thus, the amount of ink discharge can be further stabilized. Furthermore, with an improvement in the heat dissipation efficiency, the drive frequency can be increased. Accordingly, an ink-jet head having an improved discharge performance and high reliability can be provided.

The liquid-discharging heads of the present invention that have been described in the above embodiments can be installed in apparatuses such as a printer, a copying machine, a facsimile having a communication system, and a word processor having a printer unit; and industrial recording apparatus combining various processing apparatuses. Consequently, recording can be performed on various types of recording media such as paper, threads, fabrics, cloths, leathers, metals, plastics, glass, wood, and ceramics using these liquid-discharging heads.

The term "recording" used in this specification means not only that an image having meaning, such as a letter or a figure, may be deposited on a recording medium but also that an image having no meaning, such as a pattern, may be deposited on a recording medium. Furthermore, the term "ink" or "liquid" should be given a wide interpretation and means a liquid to be supplied to the formation of an image, a figure, a pattern, or the like; a processing of a recording medium; or a processing of ink or a recording medium by being deposited on the recording medium. Herein, the term "processing of ink or a recording medium" means, for example, improving the fixing property caused by coagulation or insolubilization of a coloring material contained in ink to be deposited on the recording medium, improving the recording quality or color developability, and improving image durability.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-206520 filed Aug. 8, 2007, which is hereby incorporated by reference herein in its entirety.

What is claimed is:

1. A liquid-discharging head comprising:

a substrate;

a flow passage wall-forming layer bonded to the substrate so as to form a flow passage for liquid between the substrate and the flow passage wall-forming layer, the flow passage communicating with a discharge port configured to discharge the liquid;

an element configured to generate energy used for discharging the liquid from the discharge port and provided on the flow passage wall-forming layer;

a metal layer provided with the discharge port so as to correspond to the element; and a projecting portion made of a metal and extending from the metal layer through the flow passage wall-forming layer and projecting in the direction of the substrate, wherein the projecting portion and a wall forming the discharge port are provided in different positions from each other, and the flow passage wall-forming layer is provided between the projecting portion and the wall forming the discharge port.

2. The liquid-discharging head according to claim 1, wherein the projecting portion projects into the flow passage.

3. The liquid-discharging head according to claim 1, further comprising:

a supply port configured to supply the flow passage with liquid and provided through the substrate, wherein the projecting portion projects into the supply port.

4. The liquid-discharging head according to claim 1, wherein the projecting portion projects inside the substrate.

5. The liquid-discharging head according to claim 4, wherein the projecting portion forms a part of a wall of the flow passage.

6. The liquid-discharging head according to claim 1, further comprising:

a heat-dissipating member disposed opposing the discharge port of the substrate, wherein the projecting portion penetrates through the substrate and is in contact with the heat-dissipating member.

7. The liquid-discharging head according to claim 1, wherein the flow passage wall-forming layer is made of silicon nitride.

8. The liquid-discharging head according to claim 1, further comprising:

a protective layer configured to protect the element, the protective layer being disposed between the element and the metal layer.

9. The liquid-discharging head according to claim 1, wherein the metal layer and the projecting portion are made of the same metal.

10. The liquid-discharging head according to claim 1, wherein the flow passage wall-forming layer is directly in contact with the substrate.

11. A liquid-discharging head, comprising:

a substrate;

a flow passage wall-forming layer bonded to the substrate so as to form a flow passage for liquid between the substrate and the flow passage wall-forming layer, the flow passage communicating with a discharge port configured to discharge liquid;

an element configured to generate energy used for discharging the liquid from the discharge port and provided on the flow passage wall-forming layer;

a metal layer provided with the discharge port so as to correspond to the element;

a protective layer configured to protect the element, the protective layer being disposed between the element and the metal layer; and a projecting portion made of a metal and extending from the metal layer through the flow passage wall-forming layer and projecting in the direction of the substrate, wherein the projecting portion and a wall forming the discharging port are provided in different positions from each other, and the protective layer is provided between the projecting portion and the wall forming the discharge port.

* * * * *